US005407141A

United States Patent [19]

Liebing et al.

[11] Patent Number: 5,407,141

[45] Date of Patent: Apr. 18, 1995

[54] IMPACT MILL

[75] Inventors: Stefan Liebing, Braunschweig; Helmut Zapf, Bockenem, both of Germany

[73] Assignee: Bühler GmbH, Braunschweig, Germany

[21] Appl. No.: 129,792

[22] Filed: Sep. 30, 1993

Related U.S. Application Data

[63] Continuation of Ser. No. 963,808, Oct. 20, 1992, abandoned.

[30] Foreign Application Priority Data

Nov. 7, 1991 [DE] Germany ..... 41 36 575.5

[51] Int. Cl.[6] ..... B02C 25/00

[52] U.S. Cl. ..... 241/36; 241/101.3; 241/275

[58] Field of Search ..... 241/101.3, 275, 36

[56] References Cited

U.S. PATENT DOCUMENTS

| | | | |
|---|---|---|---|
| 2,352,327 | 6/1944 | Kirn | 241/102 X |
| 2,941,732 | 6/1960 | Cross et al. | 241/101.3 |
| 3,944,146 | 3/1976 | Stockmann et al. | 241/101.3 X |
| 4,793,560 | 12/1988 | Schrödl | 241/37 X |
| 4,820,980 | 4/1989 | Dodson-Edgars | 241/37 X |
| 4,856,716 | 8/1989 | Burstedt | 241/37 X |

FOREIGN PATENT DOCUMENTS

| | | | |
|---|---|---|---|
| 3011112 | 10/1981 | Germany . | |
| 4029202 | 3/1992 | Germany . | |
| 4103468 | 8/1992 | Germany . | |
| 289830 | 2/1971 | U.S.S.R. | 241/275 |
| 1146084 | 3/1985 | U.S.S.R. | 241/36 |

*Primary Examiner*—Frances Han
*Attorney, Agent, or Firm*—Martin A. Farber

[57] ABSTRACT

Impact mill comprising a housing (1) wherein a drivable centrifugal rotor (3) rotatable about a rotational axis (8) and an impact body (7) enclosing this centrifugal rotor are provided. At least one sensor (11, 111, 211, 311, 411) is assigned to the impact ring (7), which sensor functions during the operation of the mill and which is designed for detecting at least the operational efficiency, preferably also for determining the extent of the wear of the impact ring (7). The sensor (11) senses the impact body (7) through an opening (12) in its annular or cylindrically-shaped housing (13).

14 Claims, 2 Drawing Sheets

IMPACT MILL

RELATED APPLICATION

This application is a continuation of our application Ser. No. 07/963,808 filed:: Oct. 20, 1992, now abandoned.

FIELD OF THE INVENTION

The invention relates to an impact mill comprising a housing wherein a drivable centrifugal rotor rotatable about a rotational axis and an impact body enclosing this centrifugal rotor are arranged.

Such impact mills have become known in numerous embodiments and for the most diverse purposes. The U.S. Pat. No. 2,352,327 shows an example having a closed, annular impact body, and the DE-C-30 11 112 discloses an impact body incorporating a plurality of segments. While the first-mentioned impact mill is used for shelling husk fruits, in particular cereals having a hull enclosing the grains, the latter is utilized for crushing stones.

In all these cases, the wear of the impact body, or the impact rings, respectively, represents a problem. It is true that the U.S. Pat. No. 2,352,327 shows an impact ring movable up- and downward so that the wear is averaged across the surface thereof. Thus, the service life of such a ring is prolonged, but only during the standstill of the mill will it be possible to determine when the final time for an exchange is due.

Also the DE-A-41 03 468 considers the problem of the uniform wear, however, with another method being chosen than in the case of the above-mentioned U.S. Pat. Nos. Also in this case, however, the problem of finding the appropriate time for exchanging the impact ring still remains to be solved.

SUMMARY OF THE INVENTION

It is, therefore, an object of the invention to design an impact mill of the type mentioned above in such a manner that a switching off of the mill for examining the condition of the impact ring becomes unnecessary, with the impact ring, however, maintaining its function as long as possible in order to reduce the frequency of replacement.

This aim can be achieved according to the invention by providing the impact body with at least one sensor which functions during the operation of the mill and which is provided for detecting at least the operatability, preferably also for determining the extent of the wear of the impact body. It is thus possible to detect at any time whether the mill is duly equipped. Unexpected interruptions of the milling operation can be avoided advantageously.

In the case of a multipart, particularly ring-segment-shaped design of the impact body, at least one sensor is assigned to each segment part, preferably to the impact surface areas thereof, in a further modification of the invention. This is also advantageous when using a closed ring, because the wear may occasionally occur one-sidedly or differently.

According to a preferred embodiment of the invention, it is provided to arrange the sensor so as to sense the impact body through an opening in its annular or cylindrically-shaped-housing of the impact body. This arrangement allows a particularly simple construction of the sensor, and additionally it enables impact mills already in use to be subsequently equipped with one or —if desirable—with a plurality of sensors.

Furthermore, it is suggested in accordance with the invention that a finger is provided as a sensor engaging the impact body under the influence of a biasing unit, which finger enters the interior of the annular arrangement and construction of the impact body when being worn out, with a switching signal for an indicating device and/or for a switch-off installation of the drive for the impact mill being derivable from this position of the finger. Such a design of the sensor allows a steadily troublefree operation of the sensor even in the case of heavy contamination, e.g., a great emission of dust caused by the material to be ground.

In this respect, in a further modification of the invention, it is suggested to design the opening in the housing enclosing the impact body as a slot-shaped opening and to have the finger integrally formed with a spring arm which stays on a stop face of a finger carrier, preferably under the dynamic effect of a leg spring. This design in accordance with the invention advantageously represents a construction which can be used in a most simple manner with all types of impact mills. It requires little space and its cost of production is low.

If, according to the invention, an optic or inductive, or capacitive sensor, or, preferably, a sensor activating a mechanic electric contact is employed, an extremely robust and operationally reliable impact mill will be created.

The various embodiments in accordance with the invention mentioned above result in advantageous measures which enormously enhance the reliability and economic efficiency of impact mills.

However, numerous other solutions are conceivable, which will become apparent by the following description of embodiments schematically illustrated in the drawings as follows: These embodiments substantially relate to different constructions of the sensor as an electronic installation being in an electro-optical, inductive or capacitative, operative connection with the impact body of the mill.

Due to the design of the sensor as electronic installation, a more favorable adaptation to the construction of the mill can be achieved, if desirable. In addition, according to the design of the electronic sensor, also the form and shape of the impact body can be considered while monitoring it.

BRIEF DESCRIPTION OF THE DRAWINGS

FIG. 1 shows the upper part of an impact mill in accordance with the teachings of the invention of the impact mill disclosed in the DE-A-41 03 468, which construction is preferred for the purposes of the invention, in an axial section, with respect to which

DETAILED DESCRIPTION OF THE DRAWINGS

Figure 1:
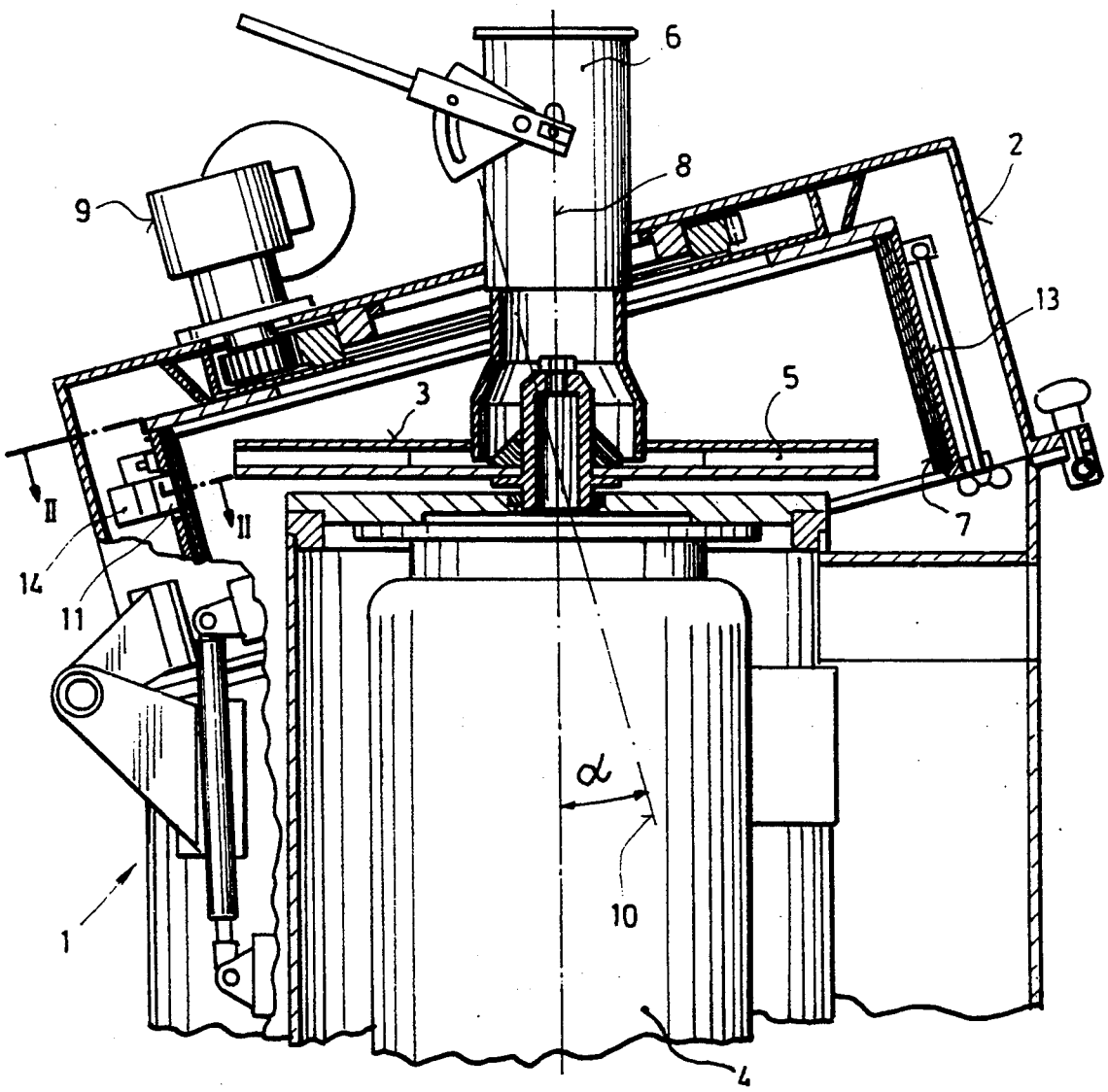

An impact mill according to FIG. 1 comprises a housing 1 with a cover 2. In the housing, there is located a centrifugal rotor or impeller 3 drivable, by means of a motor 4, to rotation. Above the centrifugal rotor 3, which can be designed as a disk, or, as shown, with closed channels 5 running at least substantially in radial direction, there is arranged a supply tube 6 via which the husk fruits, or the granular material, respectively, can be supplied to the center of rotor 3. Due to the rotation, the grains passing through the channels 5 are then thrown about a rotational axis 8, and, as a result of the centrifugal force thereby created, against an impact ring 7. For this reason, this impact ring 7 will be subjected to an increasing wear.

This wear can be averaged as preferred, by a slanting arrangement of the axis 10 of this impact ring 7 as against the axis 8 by an angle alpha if the impact ring 7 is driven to a rotational motion via a motor 9. The details of this construction, which is preferably employed within the scope of the invention since with such an arrangement the positioning of the sensor is relatively uncritical, can be seen from the DE-A-41 03 468 already mentioned previously the contents of which is incorporated herein by way of reference.

Figure 2:
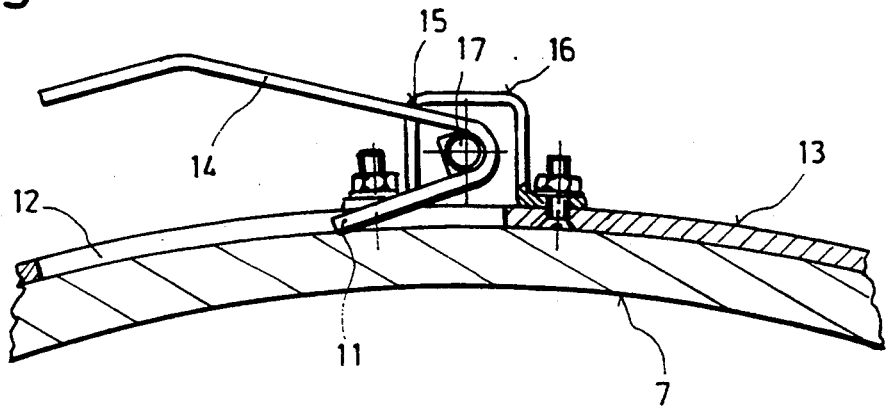
FIG. 2 illustrates an enlarged view in a section along the line II—II of FIG. 1; and the FIGS. 3 to 7 representing further possibilities of the design of a sensor in accordance with the invention.

The above-mentioned sensor provided according to the invention incorporates, in the simplest case, a sensing finger 11 becoming apparent particularly from FIG. 2, which sensing finger 11 engages the outer surface of the impact ring 7 under the effect of a biasing device through a slot-shaped opening 12 of a housing 13 enclosing the impact ring 7. This biasing device is formed, in the simplest case, by a spring arm 14 integrally formed with the finger 11, which is supported by an impact surface 15 of a finger carrier 16.

Therefore, when the impact ring 7 is completely worn down so that the thickness of material within the area of the finger 11 of the impact ring 7 has been reduced to zero, the finger 11, under the effect of the spring arm 14 or of a leg spring (not shown) connected to the arms 11 and 14, will be forced into the interior of the slot 12 and urged through it. From the position of the arm 14, the state of the impact ring 7 will then become apparent, or it can be sensed (optically, electrically, with the help off contact studs, inductively or capacitatively) by means of a sensing unit sensing the position of the arm 14. If the arm 14 itself is designed as a biasing device, its position will be indetermined when the impact ring 7 has become worn down while, if an additional biasing device (magnet, spring, pneumatic spring, or the like) is provided, the arm 14 will rotate in anticlockwise direction about a bolt 17 holding it.

If, as in the case described above, the risk is taken to let the impact ring 7 completely a disintegration of the ring and this housing covering at least a part of the outer surface of the impact ring 7), this can naturally be carried out also with other sensors rather than with the mechanical sensor 11, as shown.

Figure 3:
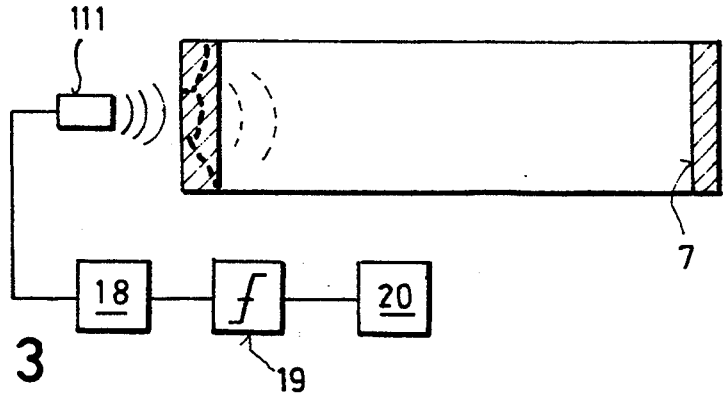

For example, FIG. 3 shows an ultrasonic sensor 111 provided in a position opposing the outer surface of the impact ring 7. The ultrasonic sensor preferably functions in transmit mode and in receive mode to enable a distance measurement to be carried out. If the outer surface of the impact ring 7 has remained inteter—as represented with unbroken lines—the sensor 111 will sense only a relatively short distance. If, however, the ring breaks through in its central area opposing the sensor 111 because it has already become too worn down, the ultrasonic waves will be reflected only by the opposite inner surface of the ring 7, i.e., the distance has increased correspondingly. In such a case, merely a distance evaluating circuit 18 and a discriminating stage 19, particularly a simple threshold switch adjoining it, need to be connected to determine whether the signals received correspond to the short or long distance, which can be signalized by an indicating unit 20 (optically and/or acoustically).

It should be understood that such a distance measurement system can be designed in a manner known per se, for example as a base distance measuring system. It would also be conceivable to provide a receiver at the inner surface of the impact ring 7 in order to operate the sensor 111 as a "barrier" as it were, for example as a light barrier (if the sensor 111 is designed as a light emitter). In such a case, the arrangement of transmitter and receiver can naturally also be reversed, with the transmitter being arranged inside and the receiver being provided outside. The advantages of such an arrangement consist not least in the fact that a distinct signal even occurs when the impact ring is arranged as being rotatable, as can be seen from FIG. 1. In such a case, when the slot or the slot opening 12 produced by wear passes, intermittent signals will occur. On the other hand, it should also be understood that a plurality of sensors may be distributed over the height of the impact ring and that also a plurality of such slit openings (and sensors, if required) may be arranged.

Figure 4:
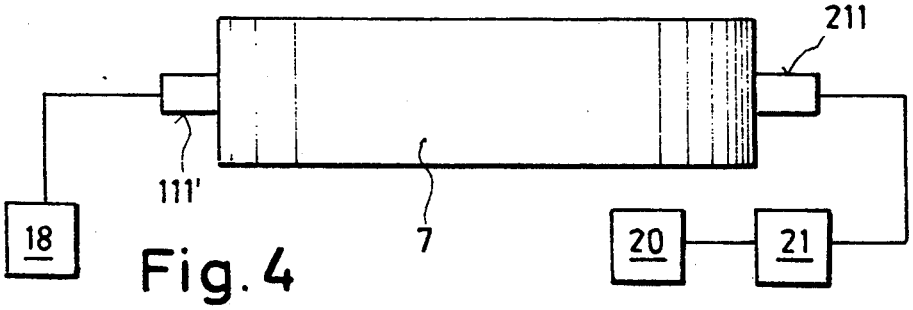

It may now be desired to be able to detect a heavy wear of the impact ring 7 at an earlier time, even before the entire impact ring has become completely worn down, with an opening being formed. Such a monitoring can be carried out in the manner of FIG. 4, by way of example. For if the ultrasonic generator 111 is applied immediately to the outer surface of the impact ring 7, so that the latter is excited to emit oscillations (which may have a lower frequency than ultrasonic frequency), an oscillating mass system will be produced whose resonant frequency is dependent on the magnitude of the mass. With increasing wear of the impact ring 7, however, the mass thereof will be reduced, which has a corresponding influence upon the resonant frequency and which can be sensed with the help of a sensor 211 connected to a frequency analysis circuit 21 (e.g., for carrying out a Fourier analysis). At the output of this frequency analysis circuit 21, there is again arranged an alarm indicating installation 20.

It may be mentioned that in the case of such an arrangement an oscillator 111 may be dispensed with, if desired, if one assumes that the granular material impinging on the inner surface of the impact ring generates oscillations itself, which oscillations—with a relatively uniform supply of the granular material occurring—will be relatively regular. However, it will also be possible to operate within the sound spectrum, with the sound level and the sound frequency changing in accordance with the degree of wear of the impact ring 7, so that at least one of these two values can be used for analysis. For this purpose, it will not be absolutely necessary to apply the receiver immediately to the outer surface of the impact ring 7, even though in most cases this will be the preferred procedure since interferring frequencies can thus be eliminated best.

Figure 5:
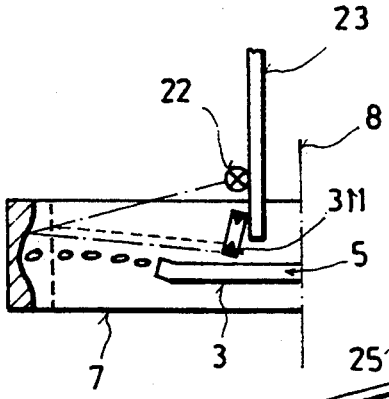

Especially in an arrangement wherein the averaging system shown in FIG. 1, with the impact ring 7, being drivable by the motor 9, is not used, so that on an "impingement equator" of the impact ring 7 the indentment caused by wear visible from FIG. 5 will be formed, the system according to FIG. 5, which is operated with reflection, can be employed to particular advantage. A light source 22 supported by a holder 23, which projects into the impact ring 7, emits light against the inner surface of the impact ring 7. As long as this inner surface is still integer, the light will be reflected against a light-electric transducer 311 (beam represented by dotted lines). However, the deeper the thickness of material of the impact ring 7 subsides in the middle, the more the reflected light beam travels downwardly until the light-electric transducer 311 receives no more light at all, which indicates that the impact ring 7 should be exchanged. Therefore, it will be convenient to arrange the transducer 311 adjustable in its height on holder 23.

Figure 6:
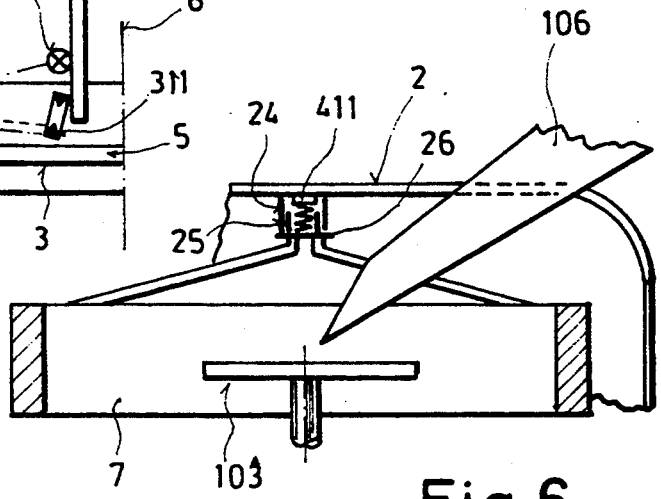

A particularly simple embodiment is visible from FIG. 6. In this arrangement, a cylinder sleeve 24 is attached to the housing cover 2 in which cylinder sleeve 24 an interior sleeve 25 is made to run telescopically. This interior sleeve 25 is fixed to the end of a spring leg 26 connected to an energy sensor 411. Therefore, the lighter the impact ring becomes due to its wear, the lower is the load of the energy receiver 411, whose weight signal is immediately applicable to an evaluating circuit or, for example, via a threshold switch (cf. 19), to an indicating installation.

By the way, the FIG. 6 shows a rotor disk 103 without inner channels (if required, with radial centrifugal walls in whose center the material to be impacted is fed via a delivery chute 106.

Figure 7:
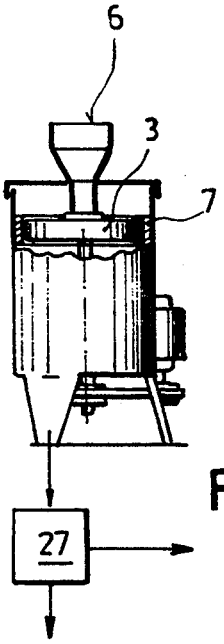

FIG. 7 represents an indirect determination of the degree of wear of the impact ring 7 wherein the material that has been impacted is then subjected in an analysis installation 27 to an examination of the efficiency of the impact procedure. For this purpose, by way of example, samples are taken within the analysis installation 27 which samples are to throw light on the husking degree or the degree of size reduction of the material. For this purpose, the installation may comprise an image analyzing installation such as it is known per se and has been described in the DE-A-40 29 202, by way of example. In this connection, the granular material is passed by a video camera, preferably in an orderly arrangement and at a predetermined speed, which video camera is connected to an image analyzer for determining its color and/or size. A further possibility consists in providing the analysis installation 27 with a separating unit, in particular with an air classifier by means of which the husks can be shelled (separated) from the kernels. Thereafter, the amount of husks is compared with the amount of the kernels, whereby the shelling result can be verified. From this shelling result conclusions can be drawn as to the degree of wear of the impact ring 7.

What is claimed is:

1. An impact mill for impacting granular material, comprising housing means defining a central axis;

supply means for said granular material, said supply means having a supply end within the range of said central axis;

impeller means rotatably supported below said supply end and being provided within a substantially horizontal plane to receive said granular material and to impart a radially outward motion to said granular material;

impeller drive means for rotating said impeller means;

an impact member having a radially inner surface and a radially outer surface and being arranged around said impeller means for functioning as an obstacle in the path of said radially outward moving granular material;

sensor means for monitoring an inner surface of said impact member and for providing a failure signal in case of a break through said impact member; and means for locating said sensor means at a location offset from said horizontal plane of said impeller means for viewing said inner surface of said impact member without impeding said motion of said granular material; and evaluating means for receiving said failure signal for evaluation.

2. Impact mill as claimed in claim 1, wherein said sensor means are arranged to monitor a break through said impact member.

3. Impact mill as claimed in claim 1, wherein said sensor means comprise at least two sensors.

4. Impact mill as claimed in claim 1, wherein said evaluating means comprise indicating means.

5. Impact mill as claimed in claim 1, wherein said evaluating means comprise switch off means for said impeller drive means.

6. An impact mill for impacting granular material, comprising housing means defining a central axis;

supply means for said granular material, said supply means having a supply end within the range of said central axis;

impeller means rotatably supported below said supply end and being provided within a substantially horizontal plane to receive said granular material and to impart a radially outward motion to said granular material;

impeller drive means for rotating said impeller means;

an impact member having a radially inner surface and a radially outer surface and being arranged around said impeller means for functioning as an obstacle in the path of said radially outward moving granular material;

sensor means for monitoring the function of said impact member and for providing a failure signal in case of misfunction of said impact member;

evaluating means for receiving said failure signal for evaluation; and holding means for holding said impact member at its radially outer surface, said holding means having at least one opening for providing access to said sensor means to the outer surface of said impact member.

7. Impact mill as claimed in claim 6, wherein said sensor means comprise mechanical sensing means and biasing means for urging said sensing means through said opening toward said outer surface, said sensing means having a signalling end for providing said failure signal.

8. Impact mill as claimed in claim 7, wherein said sensing means comprise a finger-like lever means pivotably supported on a pivot axis, said signalling end being an arm integrally formed with said lever means.

9. Impact mill as claimed in claim 8, wherein said arm is elastic.

10. Impact mill as claimed in claim 6, wherein said opening is slot-shaped.

11. An impact mill for impacting granular material, comprising housing means defining a central axis;

supply means for said granular material, said supply means having a supply end within the range of said central axis;

impeller means rotatably supported below said supply end and being provided within a substantially horizontal plane to receive said granular material and to impart a radially outward motion to said granular material;

impeller drive means for rotating said impeller means;

an impact member having a radially inner surface and a radially outer surface and being arranged around said impeller means for functioning as an obstacle in the path of said radially outward moving granular material;

sensor means for monitoring an inner surface of said impact member and for providing a failure signal in case of a break through said impact member, said sensor means being supported at a location distant from said inner surface of said impact member and radially outward of said impact member to sense a break through said inner surface of said impact member; and evaluating means for receiving said failure signal for evaluation.

12. Impact mill as claimed in claim 11, wherein said sensor provides a mechanical sensing of a break through said inner surface.

13. Impact mill as claimed in claim 11, wherein said sensor provides an acoustic sensing of the presence of said inner surface.

14. Impact mill as claimed in claim 11, wherein said sensor provides an optical sensing of the presence of said inner surface.

* * * * *